US009950266B2

(12) United States Patent
Cai

(10) Patent No.: US 9,950,266 B2
(45) Date of Patent: Apr. 24, 2018

(54) TORNADO YOYO

(71) Applicants: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

(72) Inventor: Dongqing Cai, Shantou (CN)

(73) Assignees: ALPHA GROUP CO., LTD., Guangzhou (CN); GUANGZHOU ALPHA CULTURE COMMUNICATIONS CO., LTD., Guangzhou (CN)

( * ) Notice: Subject to any disclaimer, the term of this patent is extended or adjusted under 35 U.S.C. 154(b) by 0 days.

(21) Appl. No.: 15/301,987

(22) PCT Filed: Jul. 1, 2015

(86) PCT No.: PCT/CN2015/083036
§ 371 (c)(1),
(2) Date: Oct. 5, 2016

(87) PCT Pub. No.: WO2016/206128
PCT Pub. Date: Dec. 29, 2016

(65) Prior Publication Data

US 2017/0239582 A1 Aug. 24, 2017

(30) Foreign Application Priority Data

Jun. 24, 2015 (CN) ..... 2015 2 0436761 U

(51) Int. Cl.
*A63H 1/00* (2006.01)
*A63H 1/30* (2006.01)

(52) U.S. Cl.
CPC ..... *A63H 1/30* (2013.01)

(58) Field of Classification Search
USPC ..... 446/248, 249, 250, 260, 464
See application file for complete search history.

(56) References Cited

U.S. PATENT DOCUMENTS 4,332,102 A 6/1982 Caffrey
5,017,172 A 5/1991 Seifert
(Continued)

FOREIGN PATENT DOCUMENTS

CN 101444669 6/2009
CN 201329182 10/2009
(Continued)

OTHER PUBLICATIONS

Canadian Intellectual Property Office, Office Action for CA Appl. No. 2,944,628, dated Jul. 19, 2017.
(Continued)

*Primary Examiner* — Nini Legesse
(74) *Attorney, Agent, or Firm* — Hodgson Russ LLP

(57) ABSTRACT

The present disclosure discloses a tornado yoyo, including two rotating disks and a connecting axle configured to connect back portions of the two rotating disks, in which a protruding cylinder provided with a bearing thereon is disposed in the rotating disk and located in the middle of the rotating disk; a rotating cap is disposed outside the rotating disk and provided with a connecting hole portion extending from the middle of the rotating cap to the rotating disk, and the connecting hole portion is sleeved on the bearing to realize a rotation of the rotating cap relative to the rotating disk; and an outer edge of the rotating cap is provided with an edgefold configured to envelop an edge of the rotating
(Continued)

disk, so that when the yo-yo is held or pinched in a forward direction, the rotation of the rotating disk will not be influenced.

10 Claims, 4 Drawing Sheets

(56) References Cited

U.S. PATENT DOCUMENTS

| | | | | |
|---|---|---|---|---|
| 7,125,310 | B1 * | 10/2006 | Van Dan Elzen | A63H 1/30 446/247 |
| 7,740,517 | B2 * | 6/2010 | Hochstrasser | A63H 1/30 446/250 |
| 8,764,509 | B1 | 7/2014 | Lytle | |
| 2004/0198151 | A1 * | 10/2004 | Bell | A63H 1/30 446/247 |
| 2005/0233674 | A1 | 10/2005 | Torres | |
| 2008/0171488 | A1 | 7/2008 | Van Dan Elzen | |
| 2012/0244780 | A1 * | 9/2012 | Van Dan Elzen | A63H 1/30 446/250 |

FOREIGN PATENT DOCUMENTS

| | | | |
|---|---|---|---|
| CN | 201492929 | | 6/2010 |
| CN | 202237239 | | 5/2012 |
| CN | 202579682 | | 12/2012 |
| CN | 202620691 | | 12/2012 |
| CN | 103405917 | A | 11/2013 |
| DE | 19828922 | A1 | 8/1999 |
| JP | S5595786 | A | 7/1980 |
| JP | 2000093660 | A | 4/2000 |
| WO | 2013094227 | A1 | 6/2013 |

OTHER PUBLICATIONS

EPO, Office Action for EP Application No. 15888072.4, dated Dec. 21, 2017.

JPO, Office Action for JP Application No. 2016-561278, dated Oct. 30, 2017.

* cited by examiner

TORNADO YOYO

CROSS-REFERENCE TO RELATED APPLICATIONS

The present application is a national phase entry under 35 USC § 371 of International Application PCT/CN2015/083036, filed Jul. 1, 2015, which claims the benefit of and priority to Chinese Patent Application No. 201520436761.1 filed Jun. 24, 2015, the entire disclosure of which is incorporated herein by reference.

FIELD

The present disclosure relates to a yo-yo, specifically, to a tornado yoyo.

BACKGROUND

A yo-yo in the prior art has been played with various tricks. For example, after the yo-yo is thrown out with a string and spins in a high speed at the end of the string, various fancy motions such as "walk the dog", "magic ball", "around the world" and "Paris tower" are made through operating the string, and even the various fancy motions can be cohered together to form a series of playing methods. Furthermore, some yo-yos can be played while being held by hands. For example, the yo-yo is provided with a protruding axle on an outer side of a rotating disk of the yo-yo and in the middle of the rotating disk, in which the protruding axle can rotate relative to the rotating disk, and for the convenience of holding, the protruding axle may extend beyond a disk edge of the rotating disk, and even an end surface of the protruding axle is enlarged to have a plate shape, such that the protruding axle can be pinched at two sides of the yo-yo, and the rotating disk of the yo-yo can keep rotating when the yo-yo is held by hands. Thus, in cooperation with the string's motion, there can be more playing methods. However, the yo-yo with the structures above cannot meet the requirement of the hobbyists for the playing methods gradually, as they become more skilled and try new playing methods continuously.

SUMMARY

The present disclosure aims to solve the problems above. A tornado yoyo is provided, which can not only be pinched at a side thereof, but also be held in a forward direction, so as to meet a requirement for more playing methods and thus present great enjoyments.

The technical solution of the present disclosure is realized as followed.

A tornado yoyo, includes two rotating disks and a connecting axle configured to connect back portions of the two rotating disks, in which a protruding cylinder provided with a bearing thereon is disposed within the rotating disk and located in the middle of the rotating disk; a rotating cap is disposed outside the rotating disk and provided with a connecting hole portion extending from the middle of the rotating cap to the rotating disk, and the connecting hole portion is sleeved on the bearing to realize a rotation of the rotating cap relative to the rotating disk; and an outer edge of the rotating cap is provided with an edgefold configured to envelop an edge of the rotating disk.

A gravity center of the rotating cap is coincident with a gravity center of the rotating disk, so that the yo-yo will not waggle while being played, and the rotation thereof is stable.

In order to prevent the rotating cap from contacting the rotating disk and influencing the rotation of the rotating disk as much as possible, a space defined by the edgefold and the edge of the rotating cap is larger than a disk edge of the rotating disk, and a gap exists between the edgefold and the disk edge of the rotating disk after the rotating cap is connected with the bearing.

In order to prevent the bearing from leaving off the protruding cylinder, the present disclosure may adopt following solutions. Solution one: the protruding cylinder is provided with a circle of groove close to an end thereof, and after the bearing is sleeved on the protruding cylinder, the groove extends out of the bearing, and the bearing is connected with the protruding cylinder via a retaining ring fitted in the groove. Solution two: an end of the protruding cylinder is provided with a screw hole, and after the bearing is sleeved on the protruding cylinder, a screw is screwed into the screw hole to realize a connection between the bearing and the protruding cylinder, in which the screw has a head whose diameter is larger than that of the protruding cylinder.

An outer surface of the rotating cap in the present disclosure is an evenly concave surface which is high at edge and low in middle, a center of the rotating cap is a lowest part of the concave surface, the connecting hole portion of the rotating cap is located on a bottom surface of the rotating cap, and a hole wall of the connecting hole portion is molded integrally with the rotating cap. The concave surface configured in such a manner can be used to perform a finger grind trick, thus adding a playing method of the yo-yo.

Further, a protruding axle configured to be held by a player or be plucked by a yo-yo string protrudes outwards from the middle of the outer surface of the rotating cap.

In order to increase a weight of the edge of the rotating disk and make the gravity center of the rotating disk move outwards, and also to ensure that the gravity center of the rotating disk is coincident with the gravity center of the rotating cap, the disk edge of the rotating disk is provided with a ring groove in the middle of an end surface thereof, and a counter weight ring is fitted in the ring groove.

In order to make the yo-yo more appealing to a hobbyist, the rotating disk is provided with a circular plate therein, the circular plate has a circular hole in the middle and is sleeved on the protruding cylinder of the rotating disk through the circular hole, and an outer surface of the circular plate is provided with a layer of ornamental lines or patterns.

Further, the rotating cap is configured as a transparent cap body, to allow the circular plate in the rotating disk to be observable.

In the present utility mode, the protruding cylinder provided with the bearing thereon is disposed within the rotating disk and located in the middle of the rotating disk, the rotating cap disposed outside the rotating disk and covering the rotating disk is connected with the bearing to realize the rotation of the rotating cap relative to the rotating disk, and the outer edge of the rotating cap is provided with the edgefold to envelop the edge of the rotating disk, such that when the yo-yo is held or pinched in the forward direction, fingers contact the edgefold of the rotating cap, and the rotation of the rotating disk will not be influenced. Therefore, more on-hand operation manners can be provided compared with the yo-yo in the prior art. In cooperation with an operation of a string, more new fancy motions can be realized by combination or creation, thus meeting a requirement of the hobbyist for exploring and creating a new trick of yo-yo, such that the hobbyist will not lose interest for the yo-yo easily, but rather explore continuously and obtain a joy of exploration. In addition, the outer surface of the rotating cap is designed to be the concave surface, and the concave surface may be used to realize the finger grind trick of the yo-yo; or the protruding axle protrudes outwards from the middle of the outer surface of the rotating cap and thus can be used to realize other corresponding tricks, in sum, the rotating cap is designed skillfully and integrated with various structures corresponding to various playing methods, such that the yo-yo can be played with more diverse and abundant methods. On the other hand, the counter weight ring is provided in the end surface of the disk edge of the rotating disk, so the edge of the rotating disk is weighted and the gravity center of the yo-yo moves outwards, and therefore, the yo-yo whose gravity center moves outwards is more stable when rotating. The tornado yoyo is designed skillfully, has a high integration in function and is stable when rotating, such that the tornado yoyo is suitable for a new player to use, as well as for a skilled hobbyist having an innovative consciousness of yo-yo's playing methods.

The present disclosure is illustrated further as follows in combination with drawings.

DETAILED DESCRIPTION

Figure 1:
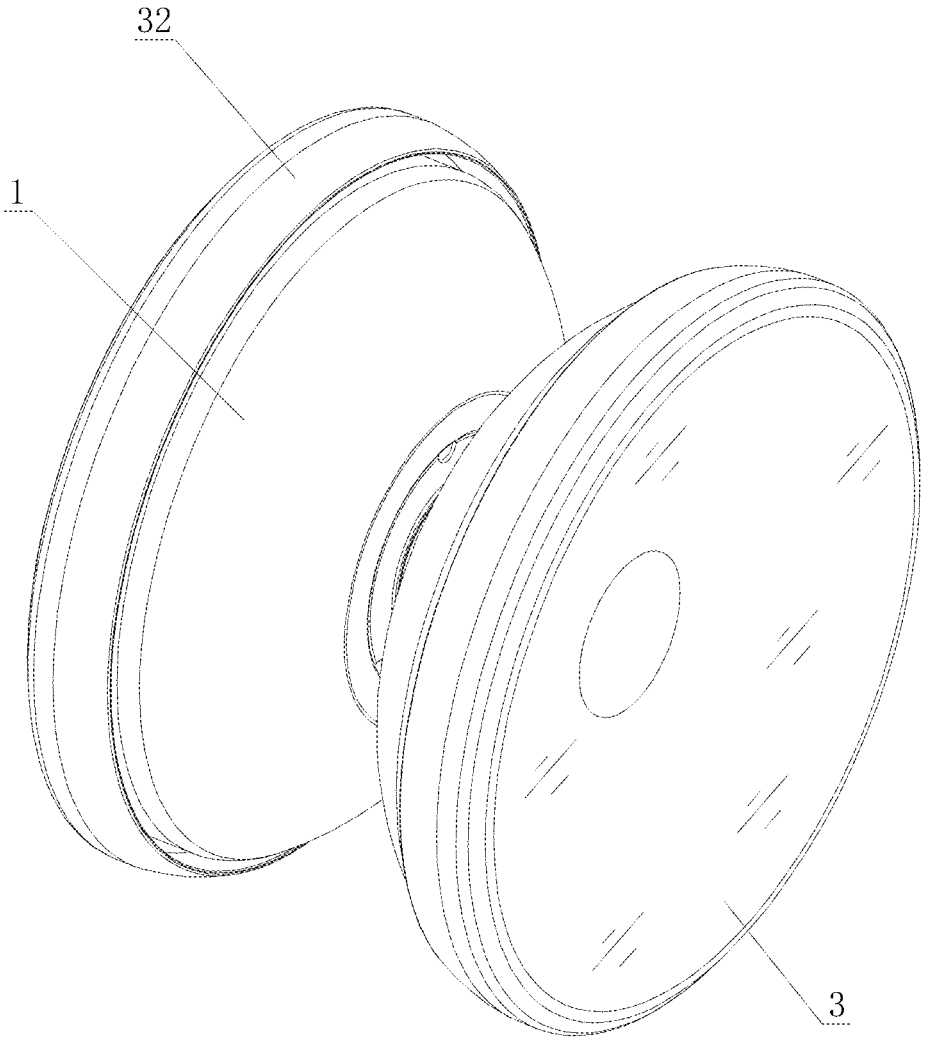
FIG. 1 is a perspective view of a first embodiment of the present disclosure.

As shown in FIG. 1 to FIG. 5, a tornado yoyo is provided, and includes two rotating disks 1 and a connecting axle 2 configured to connect back portions of the two rotating disks 1. A protruding cylinder 11 provided with a bearing 4 thereon is disposed within the rotating disk 1 and located in the middle of the rotating disk 1. A rotating cap 3 is disposed outside the rotating disk 1 and covers the rotating disk 1, the rotating cap 3 is provided with a connecting hole portion 31 extending from the middle of the rotating cap 3 to the rotating disk 1, and the connecting hole portion 31 is sleeved on the bearing 4 to realize a rotation of the rotating cap 3 relative to the rotating disk 1. An outer edge of the rotating cap 3 is provided with an edgefold 32 configured to envelop an edge of the rotating disk 1, so that when the yo-yo is held or pinched in a forward direction, fingers contact the edgefold 32 of the rotating cap 3, and therefore the rotation of the rotating disk 1 will not be influenced. As a result, more on-hand operation manners are provided compared with the yo-yo in the prior art, and in cooperation with an operation of a string, more new style fancy motions can be realized by combination or creation, thus meeting a requirement of a yo-yo hobbyist for exploring and creating a new trick of yo-yo.

Embodiment One

Figure 2:
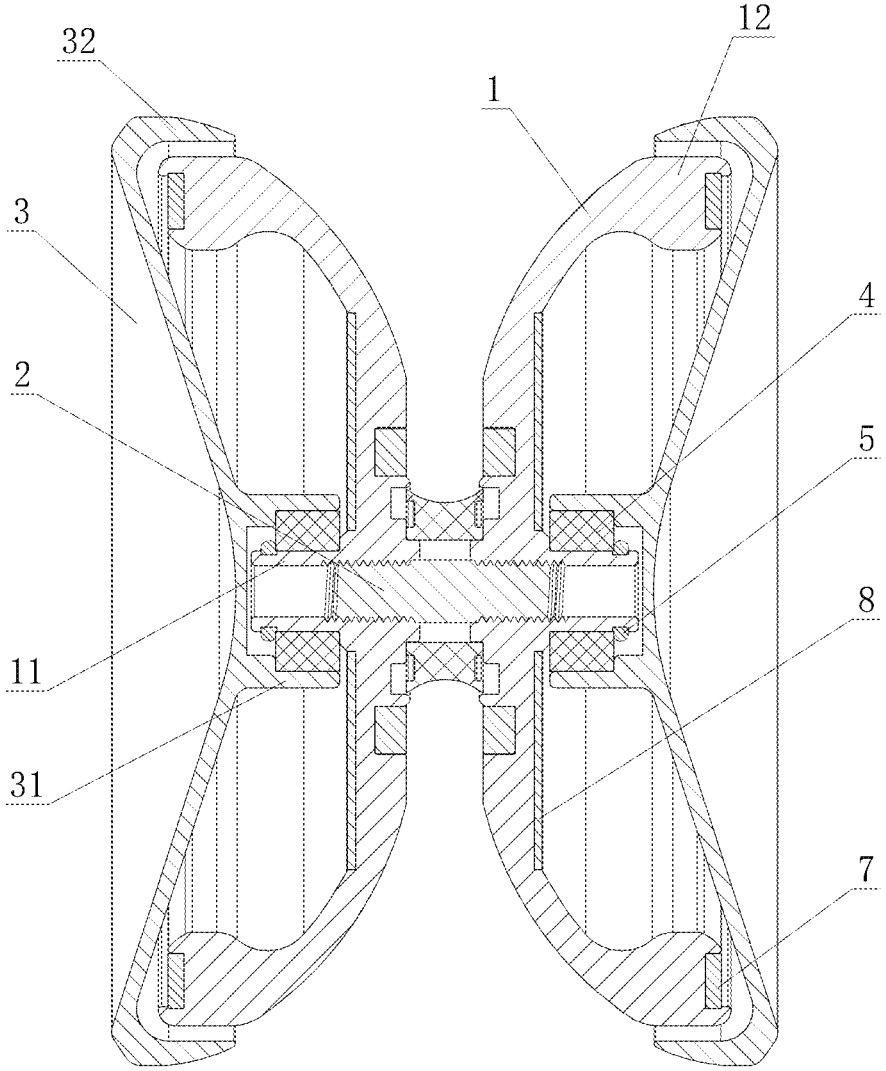
FIG. 2 is a sectional view of the first embodiment of the present disclosure.
Figure 3:
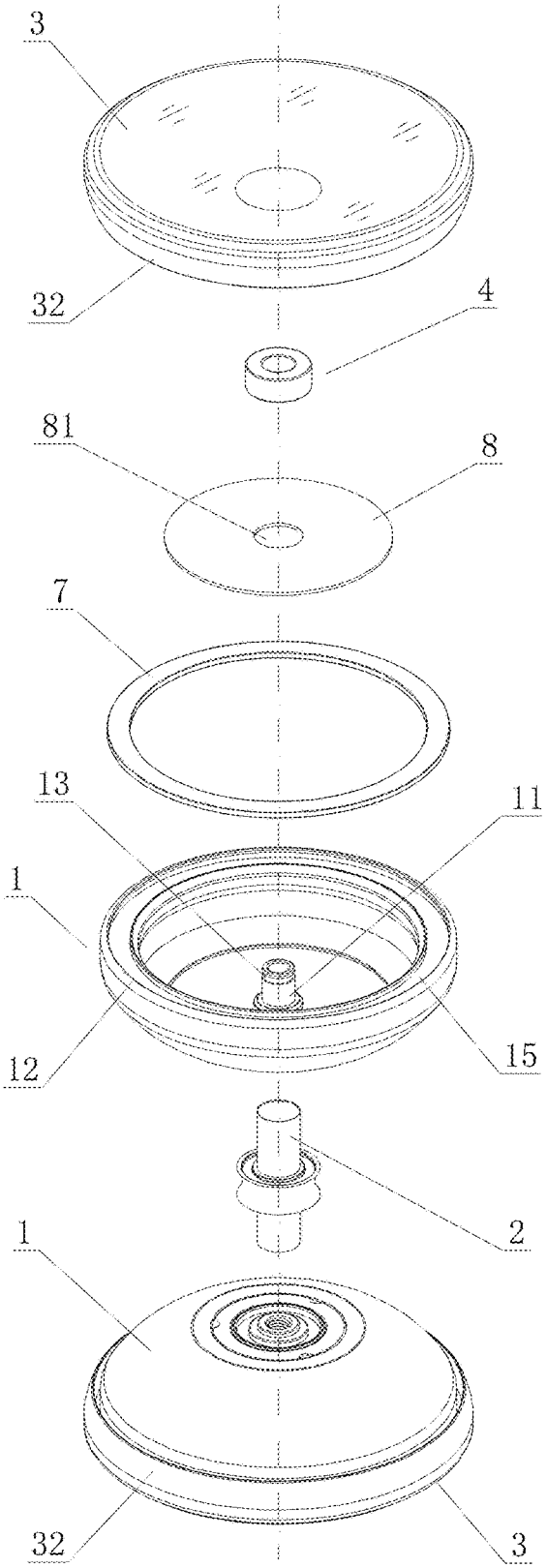
FIG. 3 is an explosive view of the first embodiment of the present disclosure.

As shown in FIG. 1 to FIG. 3, a space defined by the edgefold 32 and the edge of the rotating cap 3 is larger than a disk edge 12 of the rotating disk 1 in the present embodiment, so a gap exists between the edgefold 32 and the disk edge 12 of the rotating disk 1 when the rotating cap 3 is connected with the bearing 4, thus preventing the rotating cap 3 from contacting the rotating disk 1 and influencing the rotation of the rotating disk 1. In the present embodiment, an outer surface of the rotating cap 3 is configured as an evenly concave surface, the concave surface is high at edge and low in middle, and a center of the rotating cap 3 is a lowest part of the concave surface. The connecting hole portion 31 of the rotating cap 3 is located on a bottom surface of the rotating cap 3, and a hole wall of the connecting hole portion 31 is molded integrally with the rotating cap 3. The concave surface configured in such a manner may be used by a player to make a finger grind trick, thus further adding playing methods of the yo-yo. In the present embodiment, the protruding cylinder 11 is provided with a circle of groove 13 close to an end thereof, and when the bearing 4 is sleeved on the protruding cylinder 11, the groove 13 extends out of the bearing 4, such that the bearing 4 is connected with the protruding cylinder 11 via a retaining ring 5 fitted in the groove 13. This kind of fixing method is simple and practical. In the present embodiment, the retaining ring 5 is configured as an O-shaped rubber retaining ring, and the groove 13 is configured as a semicircle groove correspondingly. After the O-shaped rubber retaining ring 5 is fitted in the semicircle shaped groove 13, a half of the retaining ring 5 is projected out of the groove 13, so as to prevent the bearing 4 from leaving off the protruding cylinder 11, thus having an effect of stopping and position limiting. If the rotating cap 3 needs to be detached, as the O-shaped rubber retaining ring 5 has good elasticity, it is only needed to hardly pull the rotating cap 3 outwards, so as to make the bearing 4 squeeze the O-shaped rubber retaining ring 5 and thus to allow the O-shaped rubber retaining ring 5 to go through an internal diameter of the bearing 4, and thereby, the rotating cap 3 can be detached. Therefore, assembling and disassembling of the rotating cap 3 are convenient and efficient, and rotating caps 3 having different shapes can be changed as needed. In the present embodiment, the disk edge 12 of the rotating disk 1 is provided with a ring groove 15 in the middle of an end surface thereof, and a counter weight ring 7 is fitted in the ring groove 15, so that a gravity center of the rotating disk 1 moves outwards, and therefore the yo-yo is more stable when rotating. The rotating disk 1 is provided with a circular plate 8 therein, the circular plate 8 has a circular hole 81 in the middle thereof and is sleeved on the protruding cylinder 11 of the rotating disk 1 through the circular hole 81, and an outer surface of the circular plate 8 is provided with a layer of ornamental lines or patterns, or a hobbyist may stick or draw a pattern he or she likes on the outer surface of the circular plate 8, so that the yo-yo is more aesthetic and distinctive. Further, in order to observe the pattern in the circular plate 8, the rotating cap 3 may be configured as a transparent cap body correspondingly.

Embodiment Two

Figure 4:
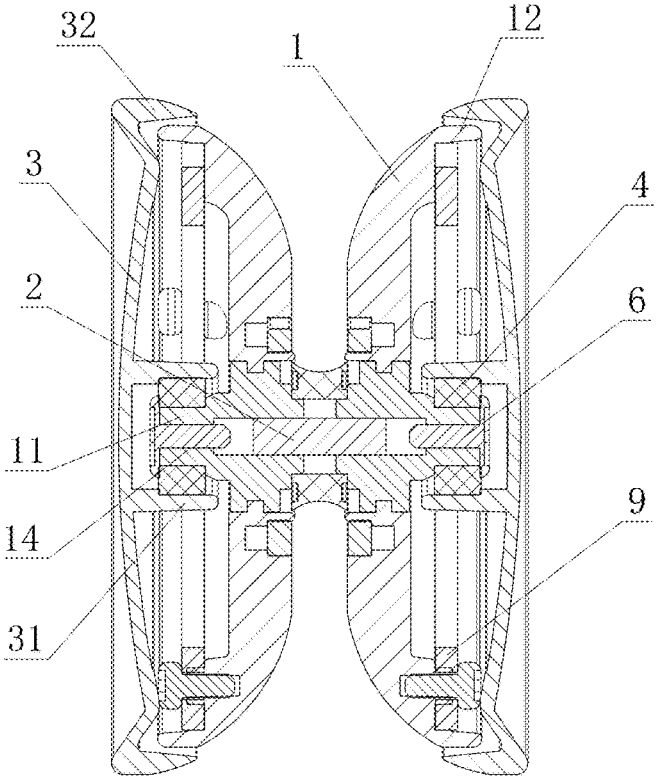
FIG. 4 is a sectional view of a second embodiment of the present disclosure.

As shown in FIG. 4, general structures of the present embodiment are identical with those of Embodiment One, while a difference therebetween is that, in the present embodiment, a connecting block is connected to the middle of the rotating disk 1, the connecting axle 2 is connected with the connecting block and the protruding cylinder 11 is also provided on the connecting block. In the present embodiment, although the rotating cap 3 is configured as a disk-shaped body having an elevated edge, the rotating cap 3 is also arched up in the middle. An end of the protruding cylinder 11 is provided with a screw hole 14, and after the bearing 4 is sleeved on the protruding cylinder 11, a screw 6 is screwed into the screw hole 14 to realize a connection between the bearing 4 and the protruding cylinder 11, in which the screw 6 has a head whose diameter is larger than that of the protruding cylinder 11. This kind of fixing method is also simple and practical, and the bearing 4 can be prevented from leaving off the protruding cylinder 11 by the head, thus providing an effect of stopping and position limiting. If the bearing 4 needs to be taken out, the rotating cap 3 is pulled out firstly, then the screw 6 is screwed out, and lastly the bearing 4 is taken out. In the present embodiment, the rotating disk 1 is provided with a counter weight ring 9 therein, and the counter weight ring 9 is fixed with the rotating disk 1 through a twist-on screw. The hobbyist can stick or draw a pattern he or she likes on an arched-up circular surface of the rotating cap 3, so as to make the yo-yo more aesthetic and distinctive.

Embodiment Three

Figure 5:
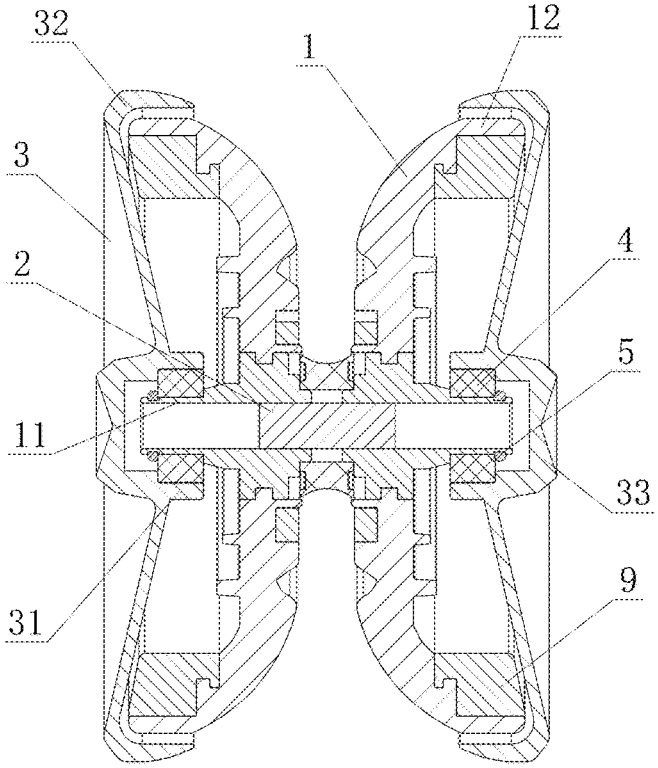
FIG. 5 is a sectional view of a third embodiment of the present disclosure.

As shown in FIG. 5, general structures of the present embodiment are identical with those of Embodiment One, while a difference therebetween is that, in the present embodiment, a connecting block is connected to the middle of the rotating disk 1, the connecting axle 2 is connected with the connecting block and the protruding cylinder 11 is also provided on the connecting block. A protruding axle 33 configured to be held by a player or be plucked by a yo-yo string protrudes outwards from the middle of an outer surface of the rotating cap 3. With such a design, when the player plays the yo-yo, he or she can not only hold the edge of the rotating cap 3 by hands, but also pinch the two protruding axles 33 by fingers, so as to allow the yo-yo to continue rotating, and furthermore, the player can also pluck the protruding axle 33 via the yo-yo string to allow the rotating yo-yo to flip. In the present embodiment, the rotating disk 1 is provided with a counter weight ring 9 therein, and the counter weight ring 9 is provided with a snap edge configured to be fastened with a snap groove formed correspondingly in the rotating disk 1, so as to be fixed.

The present disclosure is described referring to specific embodiments, but the descriptions are not intended to limit the present disclosure. Referring to the descriptions of the present disclosure, other modifications of the disclosed embodiments are predictable to those skilled in the related art, and should belong to the scope defined by the claims.

What is claimed is:

1. A tornado yoyo, comprising two rotating disks (1) and a connecting axle (2) configured to connect back portions of the two rotating disks (1), wherein, a protruding cylinder (11) provided with a bearing (4) thereon is disposed within the rotating disk (1) and located in the middle of the rotating disk (1);

a rotating cap (3) is disposed outside the rotating disk (1) and provided with a connecting hole portion (31) extending from the middle of the rotating cap (3) to the rotating disk (1), and the connecting hole portion (31) is sleeved on the bearing (4) to realize a rotation of the rotating cap (3) relative to the rotating disk (1); and an outer edge of the rotating cap (3) is provided with an edgefold (32) configured to envelop an edge of the rotating disk (1);

wherein an end of the protruding cylinder (11) is provided with a screw hole (14), and after the bearing (4) is sleeved on the protruding cylinder (11), a screw (6) is screwed into the screw hole (14) to realize a connection between the bearing (4) and the protruding cylinder (11), in which the screw (6) has a head whose diameter is larger than that of the protruding cylinder (11).

2. The tornado yoyo according to claim 1, wherein a gravity center of the rotating cap (3) is coincident with a gravity center of the rotating disk (1).

3. The tornado yoyo according to claim 1, wherein a space defined by the edgefold (32) and the edge of the rotating cap (3) is larger than a disk edge (12) of the rotating disk (1), and a gap exists between the edgefold (32) and the disk edge (12) of the rotating disk (1) after the rotating cap (3) is connected with the bearing (4).

4. The tornado yoyo according to claim 1, wherein an outer surface of the rotating cap (3) is an evenly concave surface which is high at edge and low in middle, a center of the rotating cap (3) is a lowest part of the concave surface, the connecting hole portion (31) of the rotating cap (3) is located on a bottom surface of the rotating cap (3), and a hole wall of the connecting hole portion (31) is molded integrally with the rotating cap (3).

5. The tornado yoyo according to claim 1, wherein a protruding axle (33) configured to be held by a player or be plucked by a yo-yo string protrudes outwards from the middle of an outer surface of the rotating cap (3).

6. The tornado yoyo according to claim 1, wherein a disk edge (12) of the rotating disk (1) is provided with a ring groove (15) in the middle of an end surface thereof, and a counter weight ring (7) is fitted in the ring groove (15).

7. The tornado yoyo according to claim 1, wherein the rotating disk (1) is provided with a circular plate (8) therein, the circular plate (8) has a circular hole (81) in the middle and is sleeved on the protruding cylinder (11) of the rotating disk (1) through the circular hole (81), and an outer surface of the circular plate (8) is provided with a layer of ornamental lines or patterns.

8. The tornado yoyo according to claim 6, wherein the rotating cap (3) is configured as a transparent cap body correspondingly, to allow the circular plate (8) in the rotating disk (1) to be observable.

9. The tornado yoyo according to claim 1, wherein the rotating disk (1) is provided with a counter weight ring (9) therein, and the counter weight ring (9) is fixed with the rotating disk (1) through a twist-on screw.

10. The tornado yoyo according to claim 1, wherein the rotating disk (1) is provided with a counter weight ring (9) therein, and the counter weight ring (9) is provided with a snap edge configured to be fastened with a snap groove formed correspondingly in the rotating disk (1), so as to be fixed.

* * * * *